US010366874B2

(12) United States Patent
Deisenhofer et al.

(10) Patent No.: US 10,366,874 B2
(45) Date of Patent: Jul. 30, 2019

(54) GAS DISCHARGE LAMP AND SPOTLIGHT SYSTEM COMPRISING GAS DISCHARGE LAMP

(71) Applicant: OSRAM GmbH, München (DE)

(72) Inventors: Manfred Deisenhofer, Altenmünster (DE); Carsten Klindt, Berlin (DE); Pavel Ptacek, Berlin (DE)

(73) Assignee: OSRAM GmbH, München (DE)

( * ) Notice: Subject to any disclaimer, the term of this patent is extended or adjusted under 35 U.S.C. 154(b) by 0 days.

(21) Appl. No.: 15/683,465

(22) Filed: Aug. 22, 2017

(65) Prior Publication Data

US 2018/0053646 A1 Feb. 22, 2018

(30) Foreign Application Priority Data

Aug. 22, 2016 (DE) ..... 10 2016 115 523

(51) Int. Cl.

| | |
|---|---|
| ***H01J 61/30*** | (2006.01) |
| ***F21S 8/00*** | (2006.01) |
| ***H01J 61/34*** | (2006.01) |
| ***H01J 61/82*** | (2006.01) |
| *F21W 131/406* | (2006.01) |
| *H01J 61/073* | (2006.01) |
| *F21S 2/00* | (2016.01) |

(52) U.S. Cl.

CPC ..... *H01J 61/302* (2013.01); *F21S 8/003* (2013.01); *H01J 61/34* (2013.01); *H01J 61/827* (2013.01); *F21S 2/00* (2013.01); *F21W 2131/406* (2013.01); *H01J 61/073* (2013.01)

(58) Field of Classification Search

CPC ..... H01J 61/302; H01J 61/35; H01J 61/073; F21S 8/0003; F21W 2131/406

USPC ..... 362/263, 311.03, 311.05

See application file for complete search history.

(56) References Cited

U.S. PATENT DOCUMENTS

| | | | | |
|---|---|---|---|---|
| 2,270,276 A * | 1/1942 | Doering | C09K 11/025 | 313/110 |
| 2003/0020408 A1* | 1/2003 | Higashi | H01J 61/125 | 313/637 |
| 2013/0113372 A1* | 5/2013 | Genz | H01J 61/125 | 313/641 |
| 2013/0154475 A1* | 6/2013 | Boroczki | H01J 61/125 | 313/576 |

FOREIGN PATENT DOCUMENTS

| | | |
|---|---|---|
| DE | 676726 C | 6/1936 |
| DE | 916553 C | 8/1954 |
| DE | 19 59 916 | 6/1971 |
| DE | 1959916 A1 | 6/1971 |
| DE | 201 19 231 | 3/2002 |
| DE | 10 2010 062 193 | 5/2012 |

(Continued)

OTHER PUBLICATIONS

Doering, DE 1959916—machine translation, retrieved from Espacenet.com on Jun. 16, 2018, pp. 1-3.*

(Continued)

*Primary Examiner* — Paultep Savusdiphol

(74) *Attorney, Agent, or Firm* — Boyle Fredrickson S.C.

(57) ABSTRACT

The preferred embodiments are directed to discloses a metal halide high-pressure discharge lamp comprising a burner which is enclosed by an outer bulb. In the outer bulb samarium is provided.

10 Claims, 6 Drawing Sheets

(56) References Cited

FOREIGN PATENT DOCUMENTS

| | | |
|---|---|---|
| DE | 102010062193 A1 | 5/2012 |
| EP | 0 643 021 | 3/1995 |
| EP | 1 174 905 | 1/2002 |
| JP | H08-36994 | 2/1996 |
| WO | 97/14660 | 4/1997 |

OTHER PUBLICATIONS

Search Report dated Apr. 20, 2017 in corresponding DE App. No. 10 2016 115 523.3.
Office Action dated Mar. 20, 2019 in corresponding DE App. No. 10 2016 115 523.3.

* cited by examiner

GAS DISCHARGE LAMP AND SPOTLIGHT SYSTEM COMPRISING GAS DISCHARGE LAMP

BACKGROUND OF THE INVENTION

Field of the Invention

The invention relates to a gas discharge lamp that is especially used for the lighting of sets for film and television, for show windows ("shop light"), for theater lighting, for lighting of exhibition/warehouse halls and industrial halls, for stadium lighting, for the lighting of architectural buildings and aquariums or for traffic and exterior lighting. Moreover, the invention relates to a spotlight system comprising a gas discharge lamp.

Description of Related Art

It is known to make use of halogen lamps emitting light at a color temperature of about 3200K in the field of entertainment or studio lighting. Light of said color temperature is of special advantage for said field and will play an important role also in the future. It is a drawback in this context that halogen lamps have a comparatively low energy efficiency.

Furthermore, from the state of the art energy-efficient gas discharge lamps are known. These are, for example, halogen metal vapor lamps (e.g. OSRAM HMI®/HTI® lamps). They may be used, for example, as a lamp for a spotlight akin to daylight and may emit light having a color temperature of about 6000K.

It is a drawback that for both color temperature ranges (3200K or 6000K) different lamps (halogen lamp and gas discharge lamp) and thus different spotlight systems have to be employed in order to utilize the former. For the different lamps especially lamp holders, cooling systems, lamp drivers and optical systems differing from each other have to be provided. Thus, two different spotlight systems are required for the halogen lamp and the gas discharge lamp. It is possible as an alternative to make use of a spotlight system including the gas discharge lamp which may have a color temperature of about 6000K and to provide additionally a filter, where needed, which may be e.g. an absorbing "Correct to Orange (CTO)" filter. The filter can absorb parts of the daylight spectrum and as useful light may transmit only radiation having a color temperature of 3200K. In this context, the high thermal load of the filter which usually is a gel filter or is made from plastic materials is a drawback. Therefore, it is necessary to replace said filter regularly, i.e. every one to two hours of operation. Such replacement of the filter is complicated, especially when plural spotlight systems are provided at a position that is difficult to access. Moreover, it is necessary for this purpose to interrupt an application in which the spotlight system is used, such as shots, for example.

It would be imaginable as an alternative to provide, apart from the gas discharge lamp having 6000K, a gas discharge lamp emitting light at a color temperature of about 3200K in that it includes a specific filling in its discharge tube. It is a drawback that the known fills for the discharge tube that will result in such color temperature include very aggressive components. These may attack especially the discharge tube consisting of quartz glass and thus may lead to an early end of the service life.

SUMMARY OF THE INVENTION

It is the object of the present invention to provide a gas discharge lamp which has a long service life and can be used for applications in which light of a color temperature of about 3200K, for example, is intended to be used. Moreover, it is the object of the invention to provide a spotlight system which has a simple apparatus design and is adapted to be used in gas discharge lamps for the emission of light at a color temperature of e.g. 3200K or 6000K.

This object is achieved with respect to the gas discharge lamp and spotlight system in accordance with the features of the independent claims.

Especially advantageous configurations are found in the dependent claims.

In accordance with the invention, a gas discharge lamp, especially a halogen metal vapor lamp or metal halide high-pressure discharge lamp (e.g. OSRAM HMI®/HTI® lamps) is provided. Said lamp is provided, for example, for entertainment or television or studio or architainment lighting or projection or light conductor applications or for the professional field such as film, television or theater, for example. The gas discharge lamp preferably includes an outer bulb or cladding bulb which is especially evacuated or filled with protective gas. In said bulb, a burner may be held or arranged. It includes preferably two, especially opposing, electrodes each having an electrode connection. Preferably, the outer bulb contains samarium in order to influence especially a color temperature of radiation emitted by the gas discharge lamp or of emitted useful light.

It has turned out that the color temperature may be influenced in the desired manner by the samarium of the outer bulb. Since samarium is provided in the outer bulb, the color temperature thus can be influenced independently of the burner. Therefore, in contrast to the state of the art, it is no longer necessary to provide the filling of the burner to include aggressive components in order to emit light having a color temperature of 3200K, for example. Moreover, this solution offers the advantage that, except for the outer bulb, the gas discharge lamp preferably can be configured in a conventional manner. It is thus imaginable to use the same for a spotlight system which has been provided for daylight-type lightings, for example, so far and has provided only gas discharge lamps having a color temperature of e.g. 6000K so far.

The gas discharge lamp according to the invention thus further offers the advantage that conventional gas discharge lamps in which the outer bulb then is appropriately adapted may serve as a basis. In other words, the principle according to the invention is applicable to all relevant discharge lamp types in the field of HMI/HTI, especially within the power range of from 200 W to 1800 W. If instead, as explained in the beginning, the filling of the burner would be varied for adapting a color temperature, for a gas discharge lamp the filling for a specific power would have to be newly adjusted in each case and thus newly developed and tested in each case, which is extremely cost-intensive and complicated. Thus, by the gas discharge lamp according to the invention comprising the outer bulb including samarium conventional gas discharge lamps may be used in an inexpensive and technically simple manner as a basis in the most different ranges of power.

Preferably, the outer bulb is made from doped glass or doped quartz glass including samarium. Alternatively or additionally, it would be imaginable to apply the samarium in a coating onto the outer bulb. When the glass is provided with the samarium, advantageously this leads to the fact that the outer bulb is softer, thus requiring less energy supply during manufacture, especially during reforming or bulb reforming. For example, the outer bulb is manufactured by a method having glow temperatures ranging from about 920° C. to 965° C., with glow times being possible between about two and four hours, for example.

Preferably, the samarium is provided as samarium oxide or as Sm3+ in the outer bulb. Especially preferred, samarium oxide is provided in the form of Sm2O3.

Preferably, a concentration or doping concentration of samarium or samarium oxide is chosen and/or a wall thickness of the outer bulb is chosen so that useful light emitted by the gas discharge lamp has a color temperature of approx. 3200K.

In another configuration of the invention, a share of samarium or samarium oxide is advantageously smaller than or equal to 0.6%, preferably smaller than or equal to 0.31%, preferably smaller than or equal to 0.28%, preferably smaller than or equal to 0.18% so as to avoid problems of glass homogeneity (the % relate to the composition of the mixture or of the sand mixture of which the outer bulb is formed and represent weight percent). A wall thickness of the outer bulb may be about 1.5 mm, for example.

Further preferred, the outer bulb includes cerium aluminate, especially CeAlO3, especially 0.65% CeAlO3, and/or TiO2, especially 0.04% TiO2, by which UV radiation can be suppressed or absorbed (% represent weight percent). Cerium aluminate especially serves for suppressing radiation within the UVA and UVB range. TiO2 may be provided to suppress radiation within the UVC range.

In another configuration of the invention, the outer bulb comprises Al2O3, especially 0.28% Al2O3 (preferably with 0.28% Sm2O3) (% represent weight percent). In this way, the rare earth metals Ce and Sm can better dissolve in the material, especially in the glass, of the outer bulb. Instead of 0.28% Al2O3 it is imaginable to utilize 0.20% Al2O3 (preferably with 0.20% Sm2O3) (% represent weight percent). Further preferred, a concentration of Al2O3 approximately corresponds to a concentration of samarium or samarium oxide.

A wall thickness of the outer bulb may preferably range from about 1.4 mm to 2.2 mm. In particular, the wall thickness ranges from about 1.65 mm to 2.2 mm or from about 1.4 mm to 2.0 mm. The greater the wall thickness, the lower a transmission and thus also a color temperature of the useful light may be through the outer bulb. The wall thickness may be measured, for example, at an approximately hollow-cylindrical main portion of the outer bulb.

The gas discharge lamp has a power between about 200 W and 1800 W, for instance. Preferably the gas discharge lamp has a power between 200 W and 1200 W.

With the wall thickness, for example, a color temperature ranging from about 3200K to 3750K may be set.

In another configuration of the invention, the electrode connections of the electrodes can be guided via the outer bulb to a base or to a respective base. The gas discharge lamp is based on one side or on two sides, for example. The base provided preferably is a ceramic base adapted to be used for high power. Alternatively, it is imaginable to provide a screw or pinch base. The burner of the gas discharge lamp is preferably formed of quartz glass, wherein it is also possible to use a ceramic burner.

According to the invention, a spotlight system comprising a gas discharge lamp according to one or more of the preceding aspects is provided. Thus, in contrast to the state of the art, a spotlight system comprising a gas discharge lamp may be provided which is capable of emitting useful light having a color temperature of about 3200K without a filter (CTO filter) having to be used. Moreover, such spotlight system requires little maintenance as the gas discharge lamp has a long service life. Applications such as e.g. shots hereby have to be interrupted definitely less frequently, as compared to the state of the art. In other words, a spotlight system is provided which, in connection with the gas discharge lamp according to one or more of the foregoing aspects, may irradiate from itself, i.e. without any additional filter downstream of the spotlight system, a color temperature of about 3200K as useful light. Thus, it is further imaginable to use, apart from the afore-mentioned gas discharge lamp, an identical gas discharge lamp including a daylight spectrum in the spotlight system without having to carry out any further retrofitting on the spotlight system.

Preferably the spotlight system is provided with a set of gas discharge lamps. Accordingly, either a gas discharge lamp of the set being configured according to one or more of the preceding aspects or another gas discharge lamp of the set emitting especially useful light having a color temperature of about 6000K and/or containing especially no samarium in the outer bulb can be inserted in the spotlight system. Thus, the gas discharge lamps may be mechanically exchangeable. The gas discharge lamps may be connected via an identical interface to the spotlight system, i.e. in particular via an identical base or identical bases. Hence a spotlight system is provided in which a simple exchange of the gas discharge lamps enables a color temperature of 3200K to be converted to a color temperature of 6000K and vice versa. This is done by simply exchanging the gas discharge lamps, which is resulting in a "plug-and-play" solution.

BRIEF DESCRIPTION OF THE DRAWINGS

Hereinafter, the invention shall be illustrated in detail by way of an embodiment, wherein.

DETAILED DESCRIPTION OF THE PREFERRED EMBODIMENTS

Figure 1:
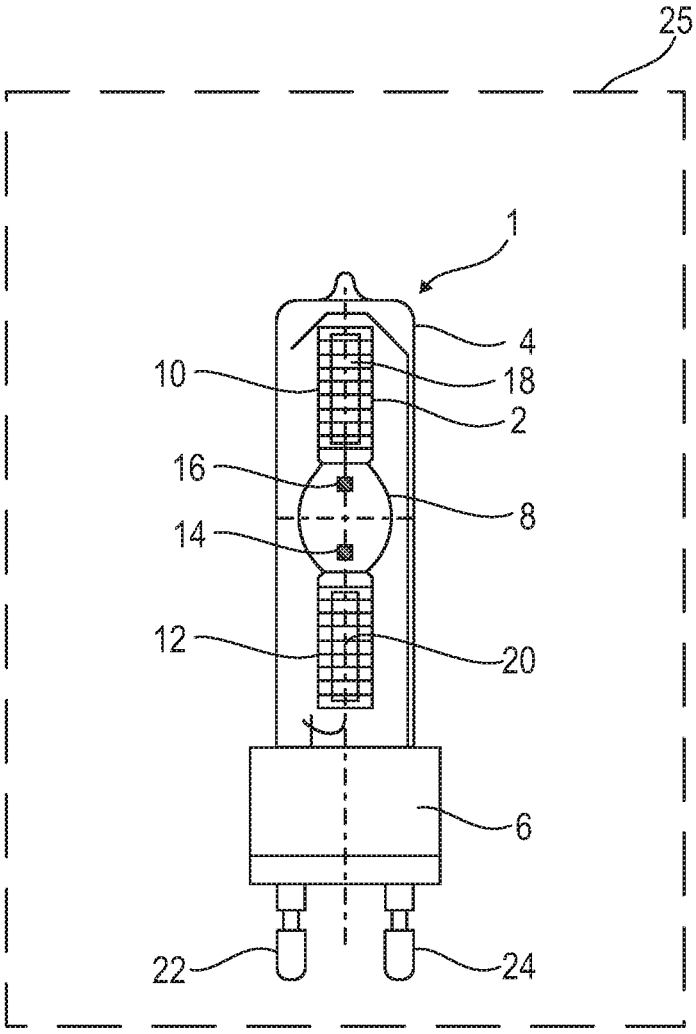
FIG. 1 shows in a schematic side view a gas discharge lamp according to the invention in accordance with an embodiment in a spotlight system.

FIG. 1 illustrates a gas discharge lamp 1 in the form of a halogen metal vapor lamp. The latter includes a burner 2 which is held in an outer bulb 4. Furthermore, the gas discharge lamp 1 is configured to be based on one side by a base 6.

The burner 2 comprises an approximately spherical or ellipsoidal discharge tube 8 away from which two shafts 10, 12 are diametrically extending. Inside the burner 8 two electrodes 14, 16 are arranged. These electrodes are connected to electrode connections 18, 20 each of which is guided through a shaft 10 or 12. Each of the electrode connections includes a portion made from a molybdenum film and enables a hermetic sealing of the discharge tube 8 in the area of the two shafts 10, 12 by a glass pinching process common in prior art. The current supplies 18, 20 are further guided downstream of the respective shaft 10, 12 between the outer bulb 4 and the burner 2 to the base 6. The latter includes two electric connections 22, 24 for establishing contact with a respective electrode connection 18, 20. The connections 22 and 24 extend from the base 6 in a direction away from the burner 2 and are arranged approximately at a distance parallel to each other and approximately at a distance parallel to the longitudinal axis of the gas discharge lamp 1.

Advantageously, the outer bulb 4 is configured of doped glass, especially doped quartz glass, containing samarium. Especially Sm2O3 is provided in the outer bulb and is distributed preferably approximately evenly in the same. Due to samarium, the gas discharge lamp 1 can emit useful light which may have a color temperature of e.g. 3200K. Thus, the gas discharge lamp 1 may replace halogen lamps, for example, which have been used for such a color temperature as yet. A gas discharge lamp according to the invention having a power of 800 W, for example, then may have a luminous flux of about 385001 m and a luminous efficiency of about 481 m/W. When a discharge lamp having 1200 W is provided, it may have a luminous flux of 645001 m and a luminous efficiency of 541 m/W. When the gas discharge lamp has 1800 W, for example, it may have a luminous flux of 928001 m and a luminous efficiency of 521 m/W. On the other hand, a conventional halogen lamp having a power ranging from 375 W to 750 W has a luminous flux of 105401 m to 219001 m and a luminous efficiency of from 281 m/W to 291 m/W. The afore-mentioned powers, luminous fluxes and luminous efficiencies are especially provided for a color temperature of about 3200K in this case.

In accordance with FIG. 1, the gas discharge lamp 1 is part of a spotlight system 25 that is schematically represented by a dashed line.

Figure 2:
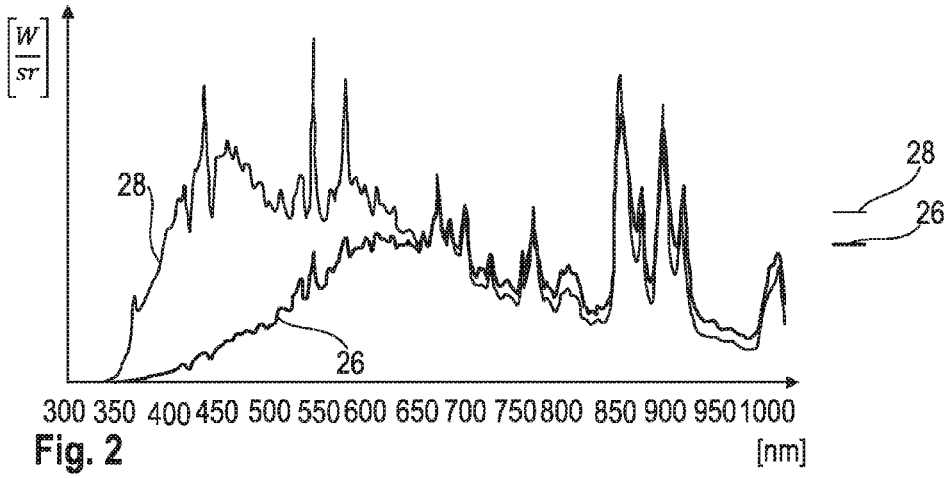
FIG. 2 shows a comparison of a light intensity of two gas discharge lamps as a function of a wavelength, FIGS. 3A and 3B each show a color rendering index of a gas discharge lamp.

According to FIG. 2, light intensities 26, 28 of two gas discharge lamps are illustrated as a function of a wavelength of emitted useful light of a respective gas discharge lamp. The curve 28 illustrates the light intensity of a gas discharge lamp emitting useful light having a color temperature of about 6000K. On the other hand, the curve 26 illustrates the light intensity of a gas discharge lamp emitting useful light having a color temperature of 3200K. From FIG. 2 it is evident that the light intensities 26, 28 are approaching each other from a wavelength of about 640 nm. Within the range of from 340 nm to 640 nm the light intensity 28 of the gas discharge lamp according to the invention having the color temperature of 6000K is considerably higher than the light intensity 26 of the gas discharge lamp having the color temperature of 3200K. Due to the higher radiation absorption in the case of the gas discharge lamp according to the invention of 3200K, it may be reasonable to increase the cooling power inside the spotlight as compared to the case of a gas discharge lamp of 6000K, e.g. by increasing a fan speed.

Figure 3A:
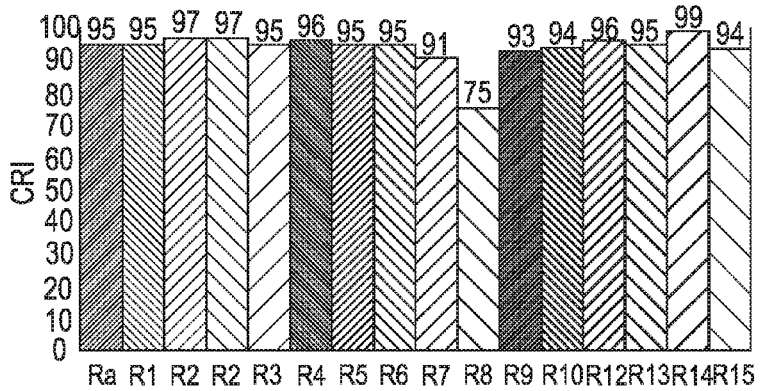
Figure 3B:
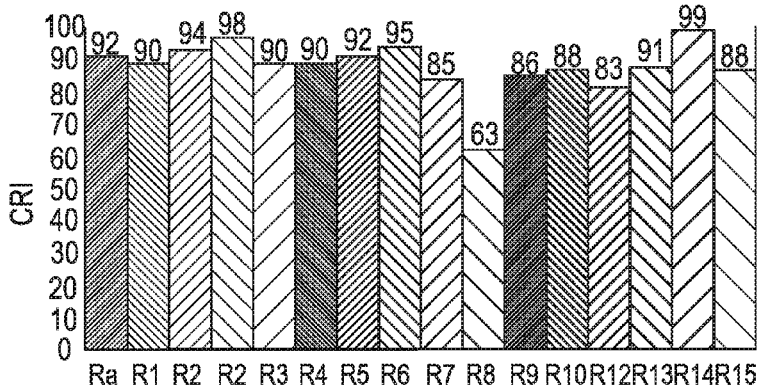

FIGS. 3*a* and 3*b* illustrate a color rendering comparison between a gas discharge lamp having a color temperature of 6000K (FIG. 3*a*) and a gas discharge lamp according to the invention having a color temperature of 3200K (FIG. 3*b*). Respective FIGS. 3*a* and 3*b* illustrate color rendering indices Ra and R1 to R15 (Color Rendering Index (CFI)). It is evident that, apart from exceptions, the color rendering indices of the gas discharge lamp having the color temperature of about 3200K (FIG. 3*b*) are slightly lower than the color rendering indices of the gas discharge lamp having the color temperature of 6000K (FIG. 3*a*). The exceptions are the color rendering indices R7 and R14 which are equal, and is the color rendering index R3 which, according to FIG. 3*b*, is higher as compared to FIG. 3*a*. Preferably, the color rendering index Ra>90 and/or the color rendering index R9>50.

Figure 4:
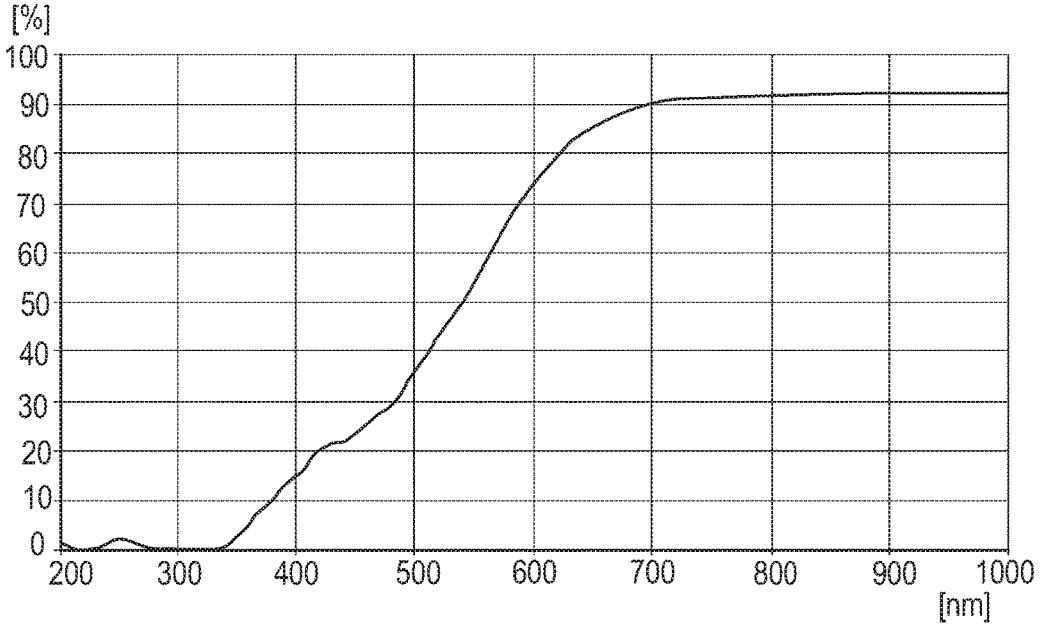
FIG. 4 shows a transmission of light as a function of a wavelength of the gas discharge lamp according to the embodiment.

FIG. 4 illustrates a transmission in percent as a function of the wavelength of a gas discharge lamp according to the invention emitting useful light having a color temperature of 3200K. The outer bulb 4, see also FIG. 1, is doped with 0.28% Sm2O3. In addition, the outer bulb may contain 0.65% CeAlO3, 0.04% TiO2 and 0.28% Al2O3 (% represent weight percent). A wall thickness of the outer bulb amounts to 1.5 mm. It can be noted that the transmission of the discharge lamp increases from about 340 nm to about 700 nm from about 0% to about 90% and subsequently will remain somewhat above 90%.

Figure 5:
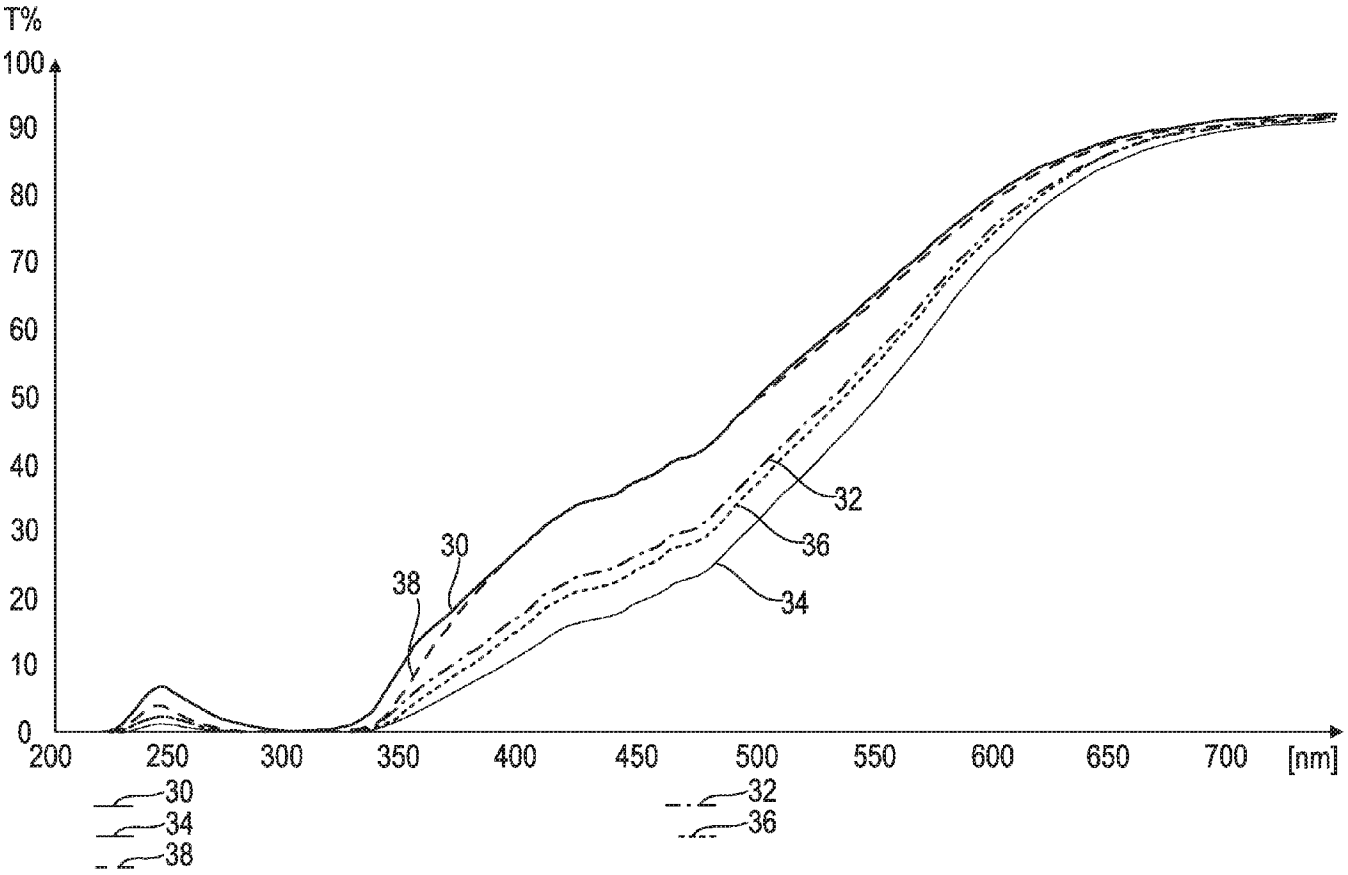
FIG. 5 shows a transmission as a function of a wavelength of different gas discharge lamps.

FIG. 5 illustrates different transmissions 30 to 38 as a function of a wavelength of a respective gas discharge lamp according to the invention.

The outer bulb 4, cf. also FIG. 1, of the gas discharge lamps having the transmission 30 to 36 contains 0.28% Sm2O3, 0.65% CeAlO3, 0.04% TiO2, 0.28% Al2O3 (% represent weight percent). The outer bulb 4 of the gas discharge lamp having the transmission 38 contains 0.20% Sm2O3, 0.65% CeAlO3, 0.04 TiO2 and 0.20% Al2O3 (% represent weight percent). The wall thickness of the outer bulb 4 of the gas discharge lamp having the transmission 30 amounts to 1.05 mm, of that having the transmission 32 amounts to 1.46 mm, of that having the transmission 34 amounts to 1.84 mm, of that having the transmission 36 amounts to 1.52 mm and of that having the transmission 38 equally amounts to 1.52 mm. It may be stated that with a larger wall thickness (1.52 mm) by reduction of the Sm2O3 concentration from 0.28% (see transmission 36) to 0.20% (see transmission 38) again approximately a transmission similar to that of a smaller wall thickness (1.05 mm) and a higher Sm2O3 concentration of 0.28% (see transmission 30) is obtained (% represent weight percent). In parallel to the reduction of the Sm2O3 concentration, advantageously also the Al2O3 concentration is reduced. Al2O3 improves the solubility of samarium in the glass, thus enabling less Al2O3 to be used with a smaller amount of samarium.

In accordance with FIG. 5 it is evident that the transmission 34 is the lowest one, followed by the transmission 36, the transmission 32, the transmission 38 and the transmission 30.

Consequently, the transmission is dependent, as to be expected, from the wall thickness, but also from the samarium concentration in the glass. Accordingly, it is obvious that the transmission in the spectral range of about 380 nm to 600 nm relevant to the reduction of the color temperature according to the invention to values ranging from about 3200K to 3750K is the higher, the lower the samarium concentration. The lower the samarium concentration, the higher the transmission in this spectral range and thus the higher the color temperature.

Figure 6:
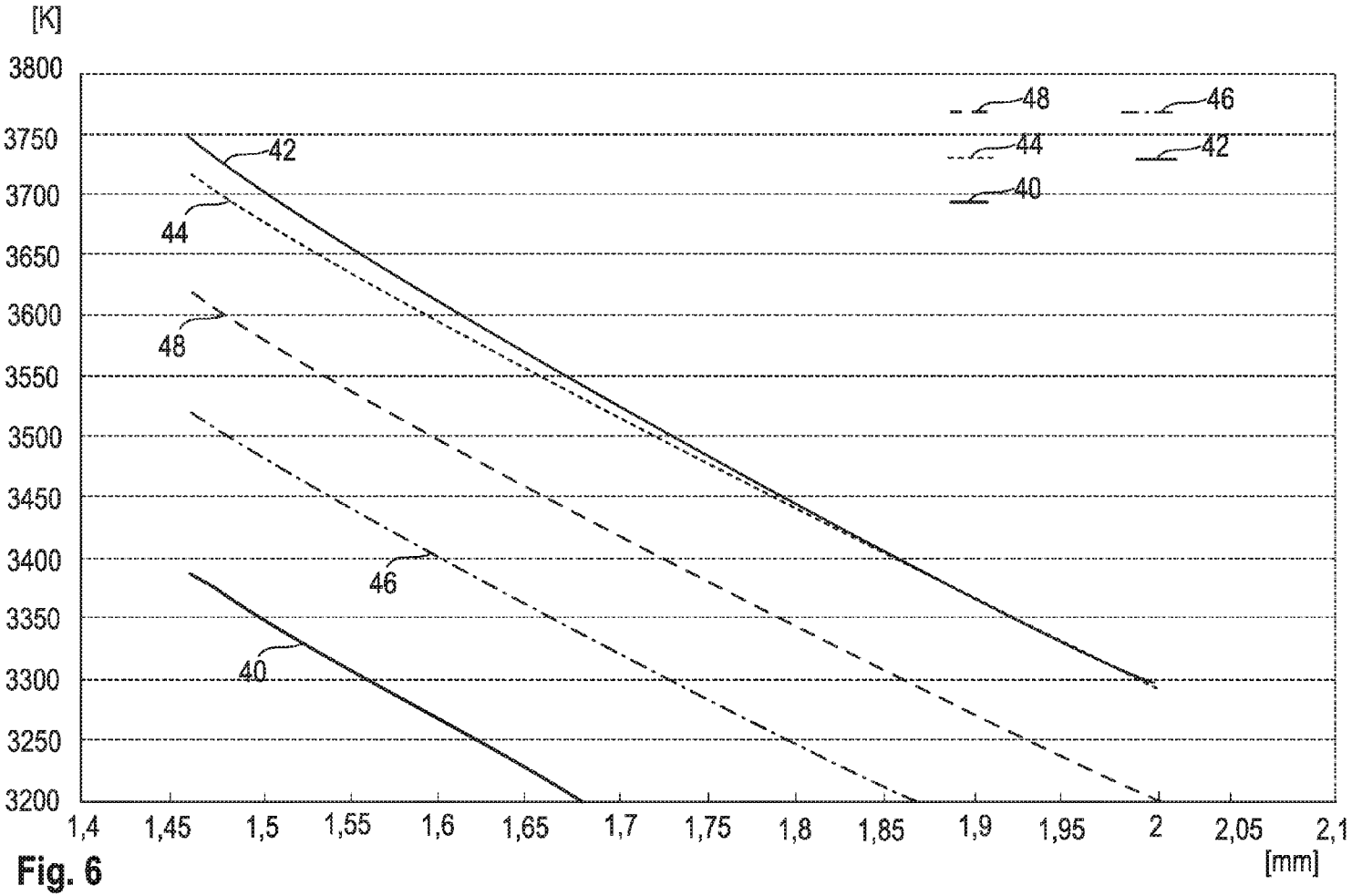
FIG. 6 shows a color temperature of a light as a function of a wall thickness of an outer bulb of different gas discharge lamps.

FIG. 6 illustrates the dependence of color temperatures 40 to 48 of different gas discharge lamps as a function of a wall thickness in mm of the outer bulb 4, cf. FIG. 1. The outer bulb 4, also see FIG. 1, includes 0.28% Sm2O3 (% represent weight percent). The color temperature 40 relates to light of a gas discharge lamp having 200 W, the color temperature 42 relates to light of a gas discharge lamp having 400 W, the color temperature 44 relates to light of a gas discharge lamp having 575 W, the color temperature 46 relates to light of a gas discharge lamp having 800 W and the color temperature 48 relates to light of a gas discharge lamp having 1200 W.

It can be inferred from FIG. 6 that a respective color temperature 40 to 48 decreases with an increasing wall thickness. The following applies to a color temperature of about 3300K: for the gas discharge lamp having 200 W a wall thickness of the outer bulb 4 of about 1.56 mm (cf. color temperature 40), for the gas discharge lamp having 400 W a wall thickness of 2.00 mm (cf. color temperature 42), for the gas discharge lamp having 575 W a wall thickness of 2.00 mm (cf. color temperature 44), for the gas discharge lamp having 800 W a wall thickness of 1.73 mm (cf. color temperature 46) and for the gas discharge lamp having 1200 W a wall thickness of 1.87 mm (cf. color temperature 48).

Figure 7:
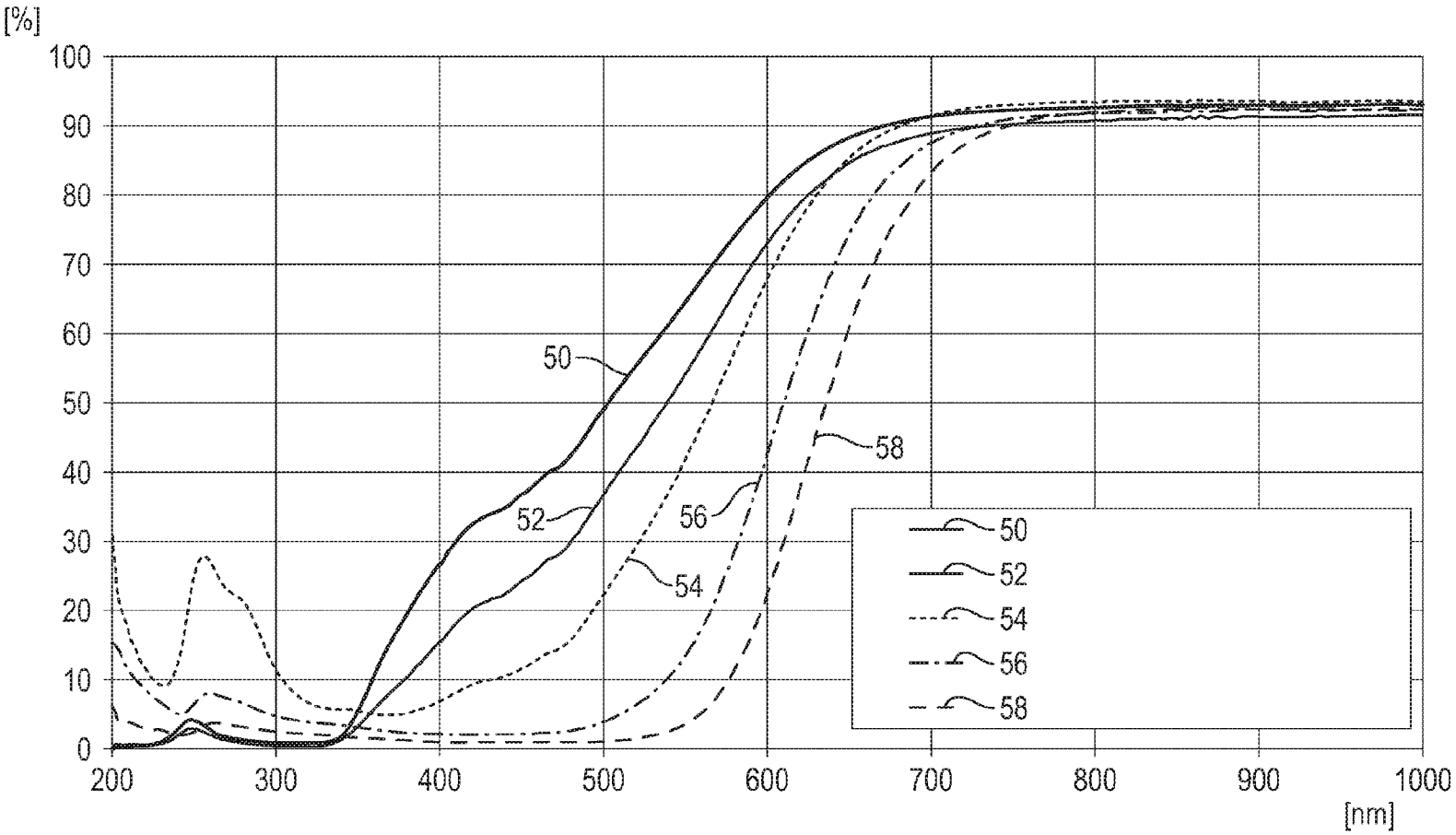
FIG. 7 shows a transmission as a function of a wave length of different gas discharge lamps.

In accordance with FIG. 7, different transmissions 50 to 58 are illustrated as a function of a wavelength for a respective gas discharge lamp according to the invention. Especially, according to FIG. 7, an influence of the samarium concentration on the transmission is shown, as already stated before in FIG. 5. The outer bulb 4, cf. FIG. 1, of the gas discharge lamp having the transmission 50 contains 0.2% $Sm_2O_3$, 0.65% $CeAlO_3$, 0.04% $TiO_2$, 0.20% $Al_2O_3$ (% represent weight percent). The outer bulb 4 of the gas discharge lamp having the transmission 52 contains 0.28% $Sm_2O_3$, 0.65% $CeAlO_3$, 0.04% $TiO_2$, 0.28% $Al_2O_3$ (% represent weight percent). The outer bulb 4 of the gas discharge lamp having the transmission 54 contains 0.3% $Sm_2O_3$, 0.3% $Al_2O_3$ (% represent weight percent). The outer bulb 4 of the gas discharge lamp having the transmission 56 contains 0.8% $Sm_2O_3$, 0.8% $Al_2O_3$ (% represent weight percent). The outer bulb 4 of the gas discharge lamp having the transmission 58 contains 2.0% $Sm_2O_3$, 2.0% $Al_2O_3$ (% represent weight percent). The wall thicknesses of the pertaining outer bulbs amount to 1.52 mm (transmission 50), 1.51 mm (transmission 52), 1.96 mm (transmission 54), 2.08 mm (transmission 56) and 2.13 mm (transmission 58). It is evident that approximately from a wavelength of 740 nm the transmissions 50 to 58 have a similar transmission which is within the range of about 90%. Especially at a wavelength between about 380 nm and 600 nm the transmission is the higher, the lower the content of $Sm_2O_3$.

The invention discloses a metal halide high-pressure discharge lamp comprising a burner which is enclosed by an outer bulb. In the outer bulb samarium is provided.

Although the best mode contemplated by the inventors of carrying out the present invention is disclosed above, practice of the above invention is not limited thereto. It will be manifest that various additions, modifications and rearrangements of the features of the present invention may be made without deviating from the spirit and the scope of the underlying inventive concept.

The invention claimed is:

1. A gas discharge lamp comprising a cylindrical outer bulb providing an enclosure in which a burner including two electrodes each having an electrode connection is arranged, wherein the cylindrical outer bulb hermetically seals the enclosure against the outside and the cylindrical outer bulb is made from doped quartz glass containing samarium.

2. The gas discharge lamp according to claim 1, wherein the samarium is provided in the form of samarium oxide, especially in the form of $Sm_2O_3$, or $Sm^{3+}$ in the outer bulb.

3. The gas discharge lamp according to claim 2, wherein the concentration of samarium or samarium oxide is selected and/or a wall thickness of the outer bulb is selected so that useful light adapted to be emitted from the gas discharge lamp has a color temperature of about 3200K.

4. The gas discharge lamp according to claim 2, wherein a part of samarium or samarium oxide or of $Sm^{3+}$ or $Sm_2O_3$ is smaller than or equal to 0.6% (weight percent).

5. The gas discharge lamp according to claim 1, wherein the outer bulb includes cerium aluminate and/or $TiO_2$ and/or $Al_2O_3$.

6. The gas discharge lamp according to claim 2, wherein the outer bulb includes $Al_2O_3$ in an amount approximately corresponding to the samarium oxide concentration.

7. The gas discharge lamp according to claim 1, wherein a wall thickness of the outer bulb ranges from 1.4 mm to 2.2 mm.

8. The gas discharge lamp according to claim 1, wherein the gas discharge lamp has a power ranging from about 200 W to 1800 W.

9. A spotlight system comprising a gas discharge lamp in accordance with claim 1.

10. The spotlight system according to claim 9, wherein said system comprises a set of gas discharge lamps, wherein said set includes at least one gas discharge lamp according to claim 1 and at least one gas discharge lamp by which useful light having a color temperature of about 6000K can be emitted and/or which includes no samarium in the outer bulb, wherein one of the gas discharge lamps is inserted in the spotlight system and the gas discharge lamps are mechanically exchangeable.

* * * * *